US011255327B2

(12) United States Patent
Liu

(10) Patent No.: US 11,255,327 B2
(45) Date of Patent: Feb. 22, 2022

(54) TWO-STAGE SCREW ROTOR MACHINE WITH SLIDE VALVES

(71) Applicant: Fu Sheng Industrial Co., Ltd, Taipei (TW)

(72) Inventor: Yao-Chung Liu, Taipei (TW)

(73) Assignee: FU SHENG INDUSTRIAL CO., LTD, Taipei (TW)

( * ) Notice: Subject to any disclaimer, the term of this patent is extended or adjusted under 35 U.S.C. 154(b) by 180 days.

(21) Appl. No.: 16/550,106

(22) Filed: Aug. 23, 2019

(65) Prior Publication Data

US 2020/0080559 A1 Mar. 12, 2020

(30) Foreign Application Priority Data

Sep. 12, 2018 (TW) ..... 107132066

(51) Int. Cl.

| | |
|---|---|
| ***F04C 18/16*** | (2006.01) |
| ***F04C 23/00*** | (2006.01) |
| ***F04C 28/12*** | (2006.01) |
| ***F04C 28/18*** | (2006.01) |

(52) U.S. Cl.

CPC ..... *F04C 18/16* (2013.01); *F04C 23/001* (2013.01); *F04C 28/12* (2013.01); *F04C 28/18* (2013.01); *F05B 2240/20* (2013.01)

(58) Field of Classification Search

CPC .. F04C 2/16; F04C 2/165; F04C 18/16; F04C 18/165; F04C 23/00; F04C 23/001; F04C 23/003; F04C 28/02; F04C 28/12; F04C 28/125; F04C 14/12; F01C 1/16; F01C 1/165; F01C 20/02; F01C 20/12; F01C 20/125; F01C 11/00; F01C 11/002; F01C 11/004; F01C 2021/1625; F01C 2021/1631

See application file for complete search history.

(56) References Cited

U.S. PATENT DOCUMENTS

| | | | | |
|---|---|---|---|---|
| 6,544,020 | B1 * | 4/2003 | Bahnen | F04C 23/001 418/88 |
| 2007/0003421 | A1 | 1/2007 | Kato et al. | |
| 2015/0292762 | A1 * | 10/2015 | Clanin | G05B 15/02 700/276 |

FOREIGN PATENT DOCUMENTS

| | | | |
|---|---|---|---|
| CN | 200940571 | Y | 8/2007 |
| CN | 102562556 | A | 7/2012 |
| CN | 104912800 | A * | 9/2015 |
| CN | 104912800 | A | 9/2015 |

(Continued)

*Primary Examiner* — Laert Dounis

(74) *Attorney, Agent, or Firm* — Li & Cai Intellectual Property (USA) Office

(57) ABSTRACT

A fluid machine includes a main body, two first screw rotors, two second screw rotors, a driving module, a first slide member and a second slide member. The two first screw rotors are meshingly engaged with each other. The two second screw rotors are meshingly engaged with each other. Two first screw rotors are arranged in the first chamber of the main body. Two second screw rotors are arranged in the second chamber of the main body. The driving module is arranged in the drive chamber of the main body. The first slide member can move relative to the two first screw rotors. The second slide member can move relative to the two second screw rotors. A fluid entering the main body exits after being compressed or expanded by the two first screw rotors and the two second screw rotors.

6 Claims, 5 Drawing Sheets

(56) References Cited

FOREIGN PATENT DOCUMENTS

| | | | | | |
|---|---|---|---|---|---|
| DE | 202008013702 | U1 | * | 12/2008 | ..... F04C 18/16 |
| DE | 102011121274 | A1 | * | 8/2012 | ..... F01C 1/16 |
| EP | 2461038 | A2 | | 6/2012 | |
| GB | 2331788 | A | | 6/1999 | |
| JP | 62006490 | U | * | 1/1987 | |
| JP | H11159490 | A | | 6/1999 | |
| JP | 2000054977 | A | | 2/2000 | |
| JP | 2005264791 | A | | 9/2005 | |
| TW | M332132 | U | | 5/2008 | |
| TW | 201326558 | A | | 7/2013 | |
| WO | WO 2013146674 | A1 | | 10/2013 | |

* cited by examiner

TWO-STAGE SCREW ROTOR MACHINE WITH SLIDE VALVES

CROSS-REFERENCE TO RELATED PATENT APPLICATION

This application claims the benefit of priority to Taiwan Patent Application No. 107132066, filed on Sep. 12, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a fluid machine, and more particularly to a fluid machine having double-segment screw rotors.

BACKGROUND OF THE DISCLOSURE

The internal volume of the conventional screw expanders or screw compressors is mostly fixed and unchangeable. Changing the internal volume ratio will require manufacturers to travel to the location of the vendor and make on-site adjustments to relevant components of the conventional screw expanders or screw compressors.

In addition, because the internal volume ratio of the conventional screw expanders or the screw compressors is fixed and unchangeable, under different usages, the expanders or the compressors may not achieve optimal usage efficiency.

SUMMARY OF THE DISCLOSURE

In response to the above-referenced technical inadequacies, the present disclosure provides a fluid machine to improve on the issues associated with difficulties in changing the volume ratio of conventional expanders or compressors.

In one aspect, the present disclosure provides a fluid machine including a main body, two first screw rotors, two second screw rotors, a driving module, a first slide member, and a second slide member. The main body is internally separated into a first chamber, a second chamber, a drive chamber, a first auxiliary chamber, and a second auxiliary chamber. The first chamber, the second chamber, and the drive chamber are in spatial communication with each other. The first auxiliary chamber is in spatial communication with the first chamber. The second auxiliary chamber is in spatial communication with the second chamber. The main body has a first port and a second port. The first port is in spatial communication with the first chamber. The second port is in spatial communication with the second chamber. The two first screw rotors are arranged in the first chamber and meshingly engaged with each other. An end of each of the two first screws rotors is arranged near the first port. The two second screw rotors are arranged in the second chamber and meshingly engaged with each other. An end of each of the two second screws rotors is arranged near the second port. A driving module is arranged in the drive chamber. The driving module is connected to one of the two first screw rotors, and is connected to one of the two second screw rotors. The driving module is controllable to drive the two first screw rotors and is controllable to the two second screw rotors. The first slide member has a first notch arranged on an end thereof, wherein the first slide member is arranged in the first auxiliary chamber, and the first slide member is configured to be controlled to move in the first auxiliary chamber so as to change the position of the first notch relative to each of the two first screw rotors. The second slide member has a second notch arranged on an end thereof, wherein the second slide member is arranged in the second auxiliary chamber, and the second slide member is configured be controlled to move in the second auxiliary chamber so as to change the position of the second notch relative to each of the two second screw rotors. When the driving module drives the two first screw rotors and the two second screw rotors, and a fluid enters into the first chamber by passing through the first port, the two first screw rotors drive the fluid to enter into the second chamber by flowing from one end of the two first screw rotors to the other end of the two first screw rotors and passing through the drive chamber, and the two second screw rotors drive the fluid in the second chamber to exit the main body from the second port by flowing from one end of the two second screw rotors to the other end of the second screw rotors.

Therefore, the fluid machine of the present disclosure includes the effects as follows. Relevant personnel or equipment can control the first slide member and the second slide member respectively or simultaneously according to practical requirements so as to adjust the positions of the first notch and the second notch respectively relative to the two first screw rotors and the two second screw rotors for changing the internal volume ratio of the fluid machine.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
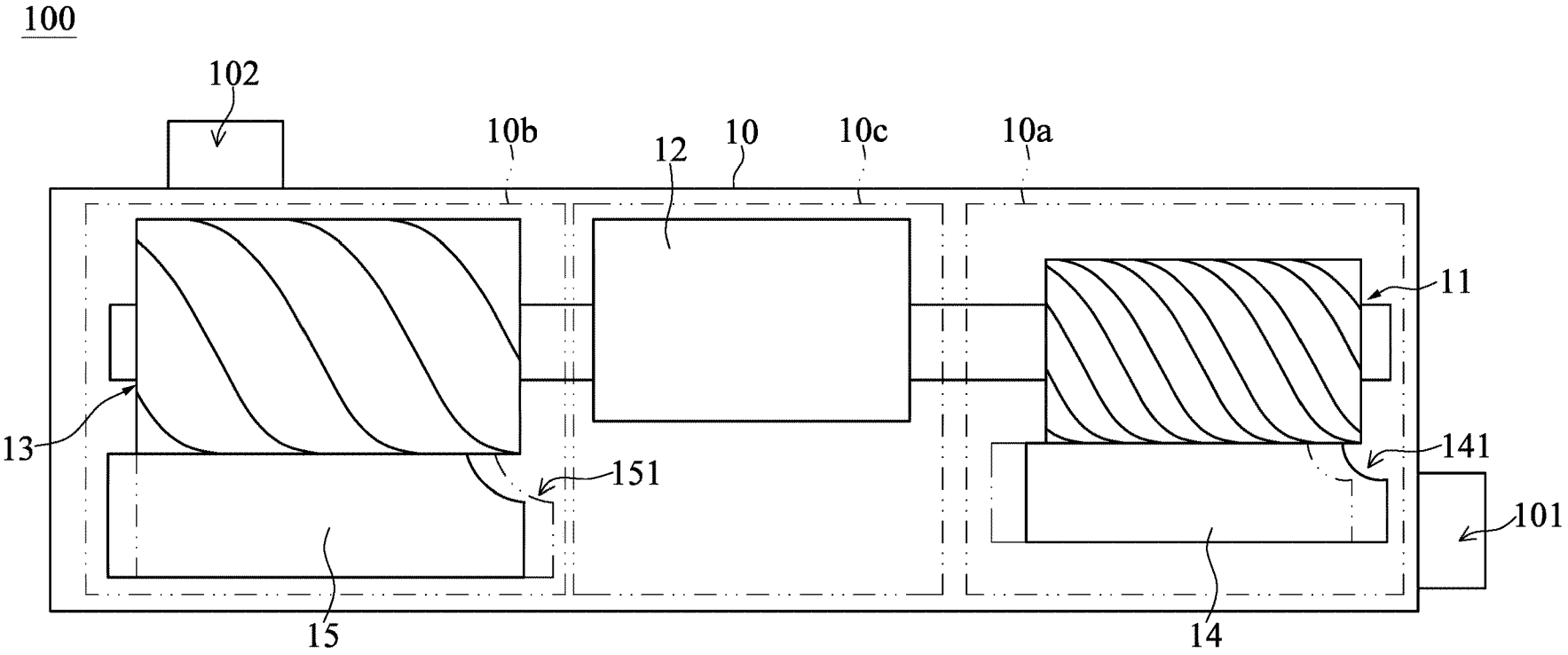
FIG. 1 is a side view of a fluid machine of the present disclosure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
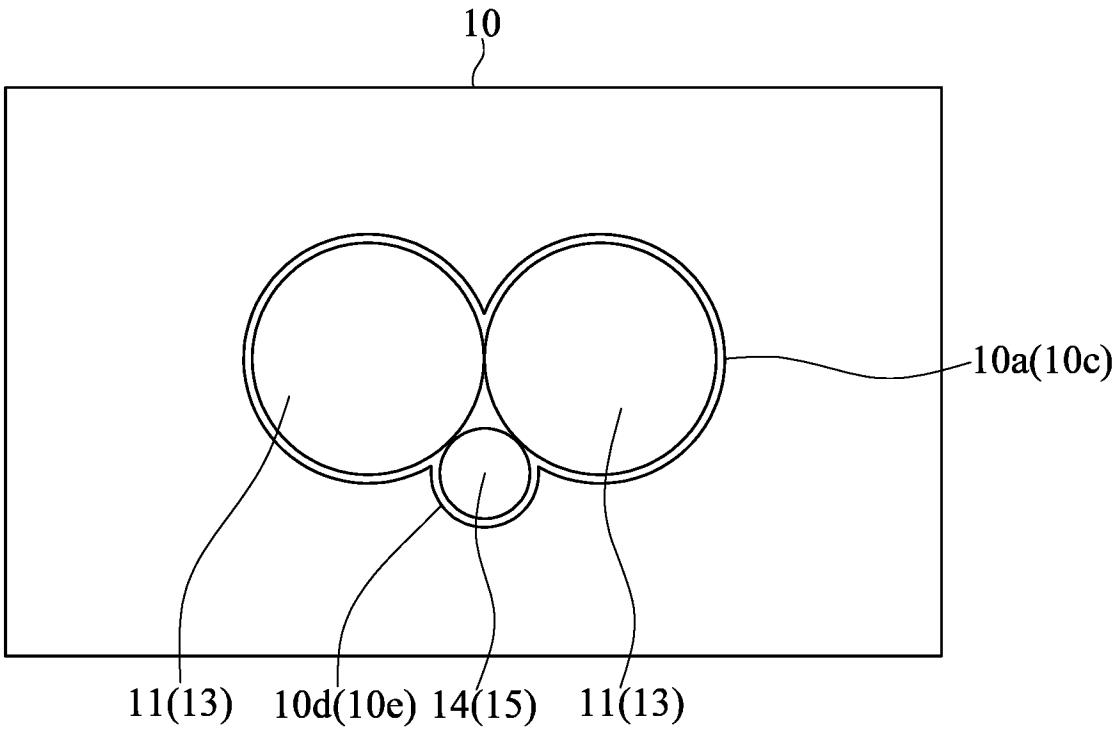
FIG. 2 is a front view of the fluid machine of the present disclosure.
Figure 3:
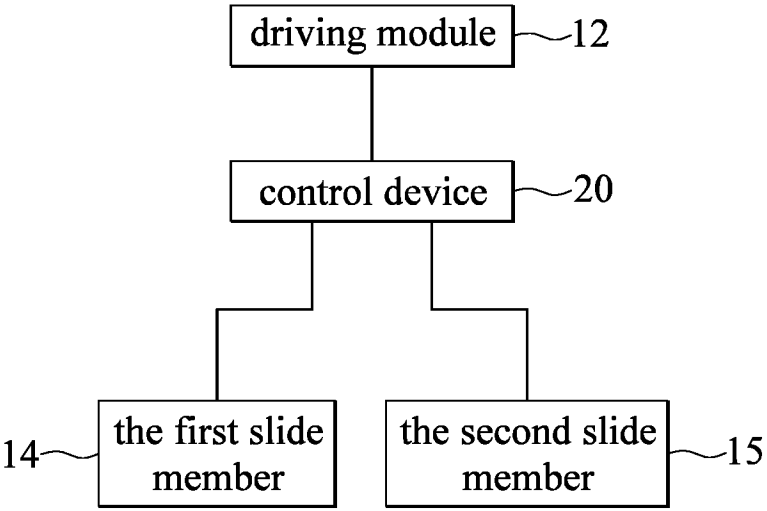
FIG. 3 is a block diagram of the fluid machine of the present disclosure according to the first embodiment of the present disclosure.

Referring to FIG. 1 to FIG. 3, FIG. 1 is a side view of a fluid machine of the present disclosure according to a first embodiment of the present disclosure. FIG. 2 is a front view of the fluid machine of the present disclosure. FIG. 3 is a block diagram of the fluid machine of the present disclosure according to the first embodiment of the present disclosure. The fluid machine 100 of the present disclosure particularly refers to the fluid machine applied to expanders or compressors. In other words, any expanders or compressors having the technical characteristics claimed in the present disclosure should fall into the scope of the present disclosure. In addition, the fluid in the following description can be gas or liquid according to practical requirements.

First Embodiment

Referring to FIG. 1 to FIG. 3, a first embodiment of the present disclosure provides a fluid machine 100 including a main body 10, two first screw rotors 11, a driving module 12, two second screw rotors 13, a first slide member 14, a second slide member 15, and a control device 20. The two first screw rotors 11, the driving module 12, the two second screw rotors 13, the first slide member 14, and the second slide member 15 are arranged in the main body 10. The control device 20 is electrically connected to the driving module 12 to control the driving module 12. The control device 20 can be integrated and arranged in a computer device or other kinds of processors of the fluid machine 100, but the present disclosure is not limited thereto.

Referring to FIG. 1 and FIG. 2, the main body 10 is internally separated into a first chamber 10*a*, a second chamber 10*b*, a drive chamber 10*c*, a first auxiliary chamber 10*d*, and a second auxiliary chamber 10*e*. The first chamber 10*a*, the second chamber 10*b*, and the drive chamber 10*c* are in spatial communication with each other. The first auxiliary chamber 10*d* is in spatial communication with the first chamber 10*a*. The second auxiliary chamber 10*e* is in spatial communication with the second chamber 10*b*. The structure of each chamber above can be changed according to practical requirements, and the present disclosure is not limited thereto. In the present embodiment, the drive chamber 10*c* is arranged between the first chamber 10*a* and the second chamber 10*b*, but the position of the drive chamber 10*c* is not limited thereto. In other embodiments of the present disclosure, the drive chamber 10*c* can be arranged at the same side of the first chamber 10*a* and the second chamber 10*b*, and the drive chamber 10*c* is not limited to being arranged between the first chamber 10*a* and the second chamber 10*b*.

Referring to FIG. 2, in practical application, the first auxiliary chamber 10*d* can be correspondingly arranged under the first chamber 10*a*, and the first auxiliary chamber 10*d* can be in spatial communication with the first chamber 10*a*. As in FIG. 1 to FIG. 3, the first auxiliary chamber 10*d* is substantially arranged under the first chamber 10*a*. However, in other embodiments of the present disclosure, the first auxiliary chamber 10*d* can be arranged above the first chamber 10*a*. Similarly, the second auxiliary chamber 10*e* can be in spatial communication with the second chamber 10*b*, and the second auxiliary chamber 10*e* can be arranged above or under the second chamber 10*b* according to requirements.

The main body 10 has a first port 101 arranged near the first chamber 10*a*, and the first chamber 10*a* is in spatial communication with the external environment through the first port 101. The main body 10 has a second port 102 arranged near the second chamber 10*b*, and the second chamber 10*b* is in spatial communication with the external environment through the second port 102. In the present embodiment, the first port 101 is substantially arranged at the right side of the main body 10 and the second port 102 is substantially arranged above the main body 10. The positions of the first port 101 and the second port 102 arranged relative to the main body 10 should not be limited to the present embodiment and can be changed according to requirements.

The two first screw rotors 11 are arranged in the first chamber 10*a*, and the two first screw rotors 11 are meshingly engaged with each other. In practical application, the two first screw rotors 11 can have different gear ratios and the distance of tooth clearance can be changed according to requirements, and the present disclosure is not limited thereto. An end of each of the two first screw rotors 11 is arranged near the first port 101, and the fluid entering into the first chamber 10*a* by passing through the first port 101 can correspondingly enter into a sealed tooth clearance between the two engaged first screw rotors 11. The fluid driven by the two first screw rotors 11 flows from one end of the two first screw rotors 11 to the other end of the second screw rotors 13, and the volume ratio of the fluid is correspondingly adjusted, that is volume of the fluid is expanded or compressed.

The driving module 12 is arranged in the drive chamber 10*c*. The driving module 12 is connected to one of the two first screw rotors 11, and is connected to one of the two second screw rotors 13. The driving module 12 can be controlled by the control device 20 so as to drive the two first screw rotors 11 and the two second screw rotors 13. More specifically, the driving module 12 can include a motor and a rotating shaft, and the rotating shaft can be connected to one of the two first screw rotors 11 and one of the two second screw rotors 13. In other embodiments of the present disclosure, the driving module 12 can be connected to one of the two first screw rotors 11 and one of the two second screw rotors 13 through a gear set.

The two second screw rotors 13 are arranged in the second chamber 10*b* and the two second screw rotors 13 are meshingly engaged with each other. In practical application, the two second screw rotors 13 can have different gear ratios and the distance of tooth clearance can be changed according to requirements, and the present disclosure is not limited thereto. The dimensions, corresponding gear ratios and so on of the two first screw rotors 11 and the two second screw rotors 13 can be designed according to practical requirements for the compression ratio or the expansion ratio, and the present disclosure is not limited thereto.

An end of each of the two second screw rotors 13 is arranged near the second port 102. After the fluid entering from the first port 101 and driven by the two first screw rotors 11 flows from one end of the two first screw rotors 11 to the other end of the two first screw rotors 11, the fluid passes through the drive chamber 10*c*, and enters into the second chamber 10*b*. The fluid entering the second chamber 10*b* enters the sealed tooth clearance between the two engaged second screw rotors 13. The fluid driven by the two second screw rotors 13 flows from one end of the two second screw rotors 13 to the other end of the two second screw rotors 13, and the volume of the fluid is expanded or compressed again. In the end, the fluid flowing through the two second screw rotors 13 exits the main body 10 through the second port 102.

The first slide member 14 is arranged in the first auxiliary chamber 10*d*. The first slide member 14 can be connected to members such as piston members, linear slides or so on, and can be driven to move (such as linear movement) in the first auxiliary chamber 10*d*. An end of the first slide member 14 has a first notch 141, and the first notch 141 is in spatial communication with part of the tooth clearance between the two engaged first screw rotors 11. In practical application, the control device 20 can be controllably connected to the piston member or the linear slide of the first slide member 14, and the control device 20 can move the first slide member 14 (such as linear movement) in the first auxiliary chamber 10*d* through controlling the piston member or the linear slide. As shown in FIG. 1 to FIG. 3, the first notch 141 is arranged at a position away from the drive chamber 10*c* and near the first port 101 on the first slide member 14, but the position of the first notch 141 should not be limited to the present embodiment. The position of the first notch 141 can be determined according to the corresponding position of the first chamber 10*a* and the drive chamber 10*c*, the position of the first port 101 or so on.

Referring to FIG. 1 and FIG. 2, when the control device 20 controls the first slide member 14 to move in the first auxiliary chamber 10*d*, the position of the first notch 141 corresponding to the two first screw rotors 11 changes, which correspondingly changes the volume of the fluid entering into the two first screw rotors 11 through the first port 101, and further changes the compression ratio or the expansion ratio of the fluid machine 100. More specifically, when the first slide member 14 in FIG. 1 is controlled to move toward the left side of the figure, the volume of the fluid entering into the first two screw rotors 11 through the first port 101 increases. Conversely, when the first slide member 14 is controlled to move toward the right side of FIG. 1, the volume of the fluid entering into the first two screw rotors 11 through the first port 101 decreases. In practical application, the structure of the first notch 141 can correspond to the structure of the two first screw rotors 11, but the present disclosure is not limited thereto.

The second slide member 15 is arranged in the second auxiliary chamber 10*e*. The second slide member 15 can be connected to members such as piston members, linear slides or so on, and can be driven to move (such as linear movement) in the second auxiliary chamber 10*e*. An end of the second slide member 15 has a second notch 151, and the second notch 151 is in spatial communication with part of the tooth clearance between the two engaged second screw rotors 13. In practical application, the control device 20 can be controllably connected to the piston member or the linear slide of the second slide member 15, and the control device 20 can move the second slide member 15 (such as linear movement) in the second auxiliary chamber 10*e* through controlling the piston member or the linear slide.

Referring to FIG. 1 and FIG. 2, when the control device 20 controls the second slide member 15 to move in the second auxiliary chamber 10*e*, the position of the second notch 151 corresponding to the two second screw rotors 13 changes, which correspondingly changes the volume of the fluid entering into the two second screw rotors 13 through the drive chamber 10*c*, and further changes the compression ratio or the expansion ratio of the fluid machine 100. In practical application, the structure of the second notch 151 can correspond to the structure of the two second screw rotors 13, but the present disclosure is not limited thereto.

In practical application, the control device 20 can be independently and controllably connected to relevant members (such as piston or linear slide) of the first slide member 14 and the second slide member 15. Through the control device 20, the first slide member 14 can be controlled to move in the first auxiliary chamber 10*d* (e.g., in a linear movement), the second slide member 15 can be controlled to move in the second auxiliary chamber 10*e* (e.g., in a linear movement), or the first slide member 14 and the second slide member 15 can simultaneously be controlled to move, according to practical requirements. As shown in FIG. 1 to FIG. 3, the second notch 151 is arranged away from the second port 102 and near the drive chamber 10*c*. However, the position of the second notch 151 should not be limited to the present embodiment and can be changed according to practical requirements.

Second Embodiment

Figure 4:
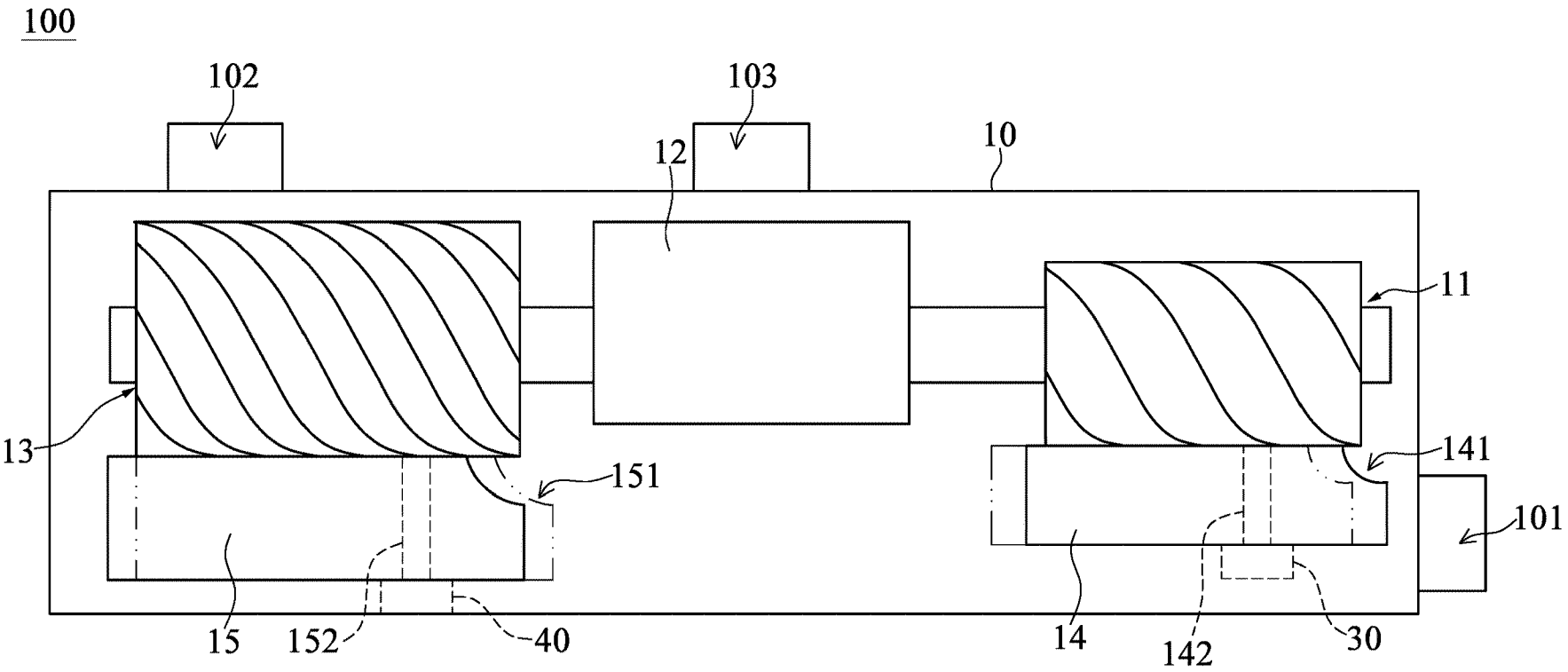
FIG. 4 is a side view of the fluid machine of the present disclosure according to a second embodiment of the present disclosure.
Figure 5:
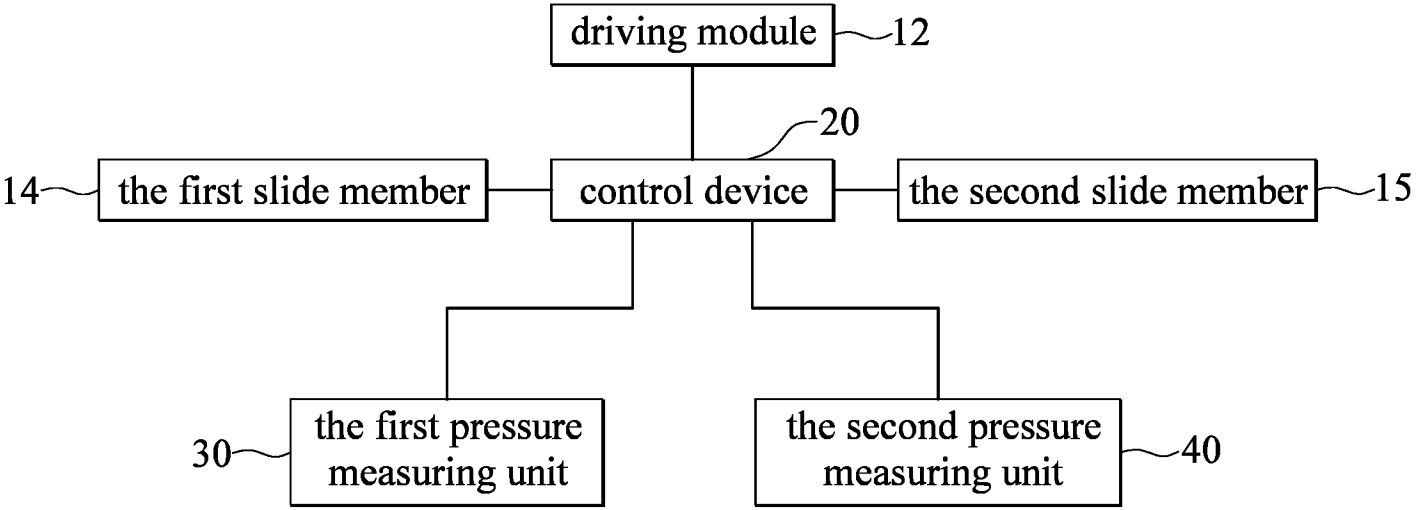
FIG. 5 is a block diagram of the fluid machine of the present disclosure according to the second embodiment of the present disclosure.

Referring to FIG. 4 and FIG. 5, FIG. 4 is a side view of a fluid machine of present disclosure according to a second embodiment of the present disclosure, and FIG. 5 is a block diagram of the fluid machine of the present disclosure according to the second embodiment of the present disclosure. As shown in FIG. 1 to FIG. 5, the main difference between the present embodiment and the previous embodiment is that the fluid machine 100 can also include a first pressure measuring unit 30 and a second pressure measuring unit 40, wherein the fluid machine 100 can only include the first pressure measuring unit 30 or the second pressure measuring unit 40, but the present disclosure is not limited thereto.

A first pressure measuring unit 30 is arranged near the first chamber 10*a* and the first auxiliary chamber 10*d*, and the first pressure measuring unit 30 is configured to measure the fluid pressure between the first slide member 14 and the two first screw rotors 11. The first pressure measuring unit 30 is electrically connected to the control device 20, and the control device 20 is configured to receive a signal generated according to the pressure measured by the first pressure measuring unit 30. In practical application, the control device 20 can include a monitor. The control device 20 can show the corresponding data on the monitor according to the signal transmitted by the first pressure measuring unit 30, and allow relevant personnel to be clearly informed of the condition of the fluid pressure of the first chamber 10*a*. The first pressure measuring unit 30 can be arranged at any position in the first chamber 10*a* according to requirements, and the present disclosure is not limited thereto. In addition, the amount of the first pressure measuring unit 30 can be increased according to practical requirements. Through the arrangement of the first pressure measuring unit 30, the relevant personnel can be aware of the change in the fluid pressure of the first chamber 10*a* after changing the position of the first slide member 14, so as to properly change the compression pressure or the expansion pressure of the fluid machine 100.

In practical application, the first slide member 14 can further have a first measuring hole 142 penetrating through the first slide member 14. The pressure measuring unit 30 can measure the fluid pressure through the first measuring hole 142. In other words, the pressure measuring unit 30 can be arranged at an end of the first measuring hole 142. The position of the first measuring hole 142 can be changed according to practical requirements. That is to say, the first measuring hole 142 can be a blind hole, and the first pressure measuring unit 30 can be correspondingly arranged in the first measuring hole 142.

A second pressure measuring unit 40 is arranged near the second chamber 10*b* and the second auxiliary chamber 10*e*, and the second pressure measuring unit 40 is configured to measure the fluid pressure between the second slide member 15 and the two second screw rotors 13. The second pressure measuring unit 40 is electrically connected to the control device 20, and the control device 20 is configured to receive the signal generated according to the pressure measured by the second pressure measuring unit 40. In practical application, the control device 20 can include a monitor, and the relevant personnel can observe the fluid pressure data of the second chamber 10*b* measured by the second pressure measuring unit 40 on the monitor. The arranged position and number of the second pressure measuring unit 40 can be changed according to requirements, and the present disclosure is not limited thereto. Through the arrangement of the second pressure measuring unit 40, the relevant personnel can be aware of the change in the fluid pressure of the second chamber 10*b* after changing the position of the second slide member 15, so as to properly change the compression pressure or the expansion pressure of the fluid machine 100.

In practical application, the second slide member 15 can have a second measuring hole 152 according to the type of the second pressure measuring unit 40 and the different arranged positions of the second pressure measuring unit 40. The second pressure measuring unit 40 can be arranged correspondingly at an end of the second measuring hole 152. Therefore, the second pressure measuring unit 40 can measure the fluid pressure of the second chamber 10*b* through the second measuring hole 152. According to practical requirements, the second measuring hole 152 can be a blind hole.

It should be noted that, the first pressure measuring unit 30 can be arranged at different positions in the first chamber 10*a* according to practical requirements, so as to measure the fluid pressure at the two first screw rotors 11 and the first notch 141, or the fluid pressure at the tooth clearance between the two engaged first screw rotors 11. Similarly, the second pressure measuring unit 40 is configured to measure the fluid pressure at the second screw rotors 13 and the second notch 151, or the fluid pressure between the two engaged second screw rotors 13.

In addition, a fluid pressure measuring unit can be arranged at the first port 101 and the second port 102. Therefore, the related personnel can decide the quantity of movement of the first slide member 14 and the second slide member 15 according to the pressure value measured by the fluid pressure measuring unit of the first pressure measuring unit 30 arranged at the first port 101 and the pressure measured by the fluid pressure measuring unit of the second pressure measuring unit 40 arranged at the second port 102, so as to make the fluid machine 100 to achieve better compression efficiency or expansion efficiency.

In other embodiments of the present disclosure, the control device 20 can automatically adjust the first slide member 14 according to preset instructions and the pressure value measured in real time by the first pressure measuring unit 30. Similarly, the control device 20 can automatically adjust the second slide member 15 according to the preset instructions and the pressure value measured in real time by the second pressure measuring unit 40.

It is worth mentioning that, as shown in FIG. 2, when the fluid machine 100 of the present disclosure is applied as a compressor, the fluid (such as a refrigerant or a coolant) passing through the two first screw rotors 11 first enters into the drive chamber 10*c*, and subsequently enters into the second chamber 10*b*. Therefore, the fluid passing through the two first screw rotors 11 can cool down the driving module 12 arranged in the drive chamber 10*c*, so as to increase the operational efficiency of the driving module 12. In addition, the main body 10 can include a third port 103 being in spatial communication with the drive chamber 10*c*. The third port 103 is configured to be injected with a cooling fluid so as to cool down the driving module 12 in operation. Therefore, through the cooling effect of the cooling fluid and the cooling effect of the fluid passing through the first screw rotors 11, the operational efficiency of the driving module 12 can be effectively increased.

In conclusion, through the arrangement of the first slide member and arrangement of the second slide member in the fluid machine of the present disclosure, the relevant personnel can correspondingly change the volume of the fluid entering between the two first screw rotors or the volume of the fluid entering between the two second screw rotors by controlling the first slide member, the second slide member or both according to requirements. Therefore, the relevant personnel can adjust the compression efficiency or the expansion efficiency of the fluid machine, and ensure that the fluid machine has good operational efficiency.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A fluid machine, comprising:

a main body internally separated into a first chamber, a second chamber, a drive chamber, a first auxiliary chamber, and a second auxiliary chamber, wherein the first chamber, the second chamber, and the drive chamber are in spatial communication with each other, the first auxiliary chamber is in spatial communication with the first chamber, and the second auxiliary chamber is in spatial communication with the second chamber; wherein the main body includes a first port and a second port, the first port is arranged at a right side of the main body, and the second port is arranged above the main body, and wherein the first port is in spatial communication with the first chamber and the second port is in spatial communication with the second chamber;

two first screw rotors arranged in the first chamber and meshingly engaged with each other, wherein an end of each of the two first screw rotors is adjacent to the first port;

two second screw rotors arranged in the second chamber and meshingly engaged with each other, wherein an end of each of the two second screw rotors is adjacent to the second port;

a driving module arranged in the drive chamber, connected to one of the two first screw rotors, and connected to one of the two second screw rotors, wherein the driving module is controllable to drive the two first screw rotors and to drive the two second screw rotors;

a first slide member having a first notch arranged on an end thereof, wherein the first slide member is arranged in the first auxiliary chamber, and the first slide member is configured to be controlled to move in the first auxiliary chamber so as to change a position of the first notch relative to each of the two first screw rotors, and wherein the first notch is arranged at the position away from the drive chamber and near the first port on the first slide member;

a second slide member having a second notch arranged on an end thereof, wherein the second slide member is arranged in the second auxiliary chamber, and the second slide member is configured to be controlled to move in the second auxiliary chamber so as to change a position of the second notch relative to each of the two second screw rotors, and wherein the second notch is arranged away from the second port and near the drive chamber, a first pressure measuring unit arranged in the first chamber, wherein the first pressure measuring unit is disposed on a surface of the first slide member, the first pressure measuring unit is configured to measure a fluid pressure between the first slide member and the two first screw rotors, and the first pressure measuring unit is configured to linearly move with the first slide member, and a second pressure measuring unit arranged in the second chamber, wherein the second pressure measuring unit is disposed on a surface of the second slide member, the second pressure measuring unit is configured to measure fluid pressure between the second slide member and the two second screw rotors, and the second pressure measuring unit is configured to linearly move with the second slide member, wherein when the driving module drives the two first screw rotors and the two second screw rotors and a fluid enters into the first chamber by passing through the first port, the two first screw rotors drive the fluid to enter into the second chamber by flowing from one end of the two first screw rotors to the other end of the two first screw rotors and passing through the drive chamber, and the two second screw rotors drive the fluid in the second chamber to exit the main body from the second port by flowing from one end of the two second screw rotors to the other end of the second screw rotors.

2. The fluid machine according to claim 1, wherein the main body further includes a third port in spatial communication with the drive chamber, and the third port is configured to be injected with a cooling fluid so as to cool down the driving module in operation.

3. The fluid machine according to claim 1, further comprising a control device electrically connected to the first pressure measuring unit, wherein the control device is configured to control the first slide member according to a result measured by the first pressure measuring unit so as to move the first slide member in the first auxiliary chamber for changing the position of the first notch relative to the two first screw rotors.

4. The fluid machine according to claim 3, wherein the first slide member has a first measuring hole penetrating through the first slide member, and the first pressure measuring unit is configured to measure the fluid pressure between the first slide member and the two first screw rotors through the first measuring hole.

5. The fluid machine according to claim 1, further comprising a control device electrically connected the second pressure measuring unit, wherein the control device is configured to control the second slide member according to a result measured by the second pressure measuring unit so as to move the second slide member in the second auxiliary chamber for changing the position of the second notch relative to the two second screw rotors.

6. The fluid machine according to claim 5, wherein the second slide member has a second measuring hole penetrating through the second slide member, and the second pressure measuring unit is configured to measure the fluid pressure between the second slide member and the two second screw rotors through the second measuring hole.

* * * * *